US006831620B1

(12) United States Patent
Nishikubo et al.

(10) Patent No.: US 6,831,620 B1
(45) Date of Patent: Dec. 14, 2004

(54) SOURCE DRIVER, SOURCE LINE DRIVE CIRCUIT, AND LIQUID CRYSTAL DISPLAY DEVICE USING THE SAME

(75) Inventors: Keishi Nishikubo, Tenri (JP); Toshihiro Yanagi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 436 days.

(21) Appl. No.: 09/626,234

(22) Filed: Jul. 26, 2000

(30) Foreign Application Priority Data

Jul. 26, 1999 (JP) ..... 11-210350
Jul. 7, 2000 (JP) ..... 2000-207015

(51) Int. Cl.[7] ..... G09G 3/36
(52) U.S. Cl. ..... 345/87; 345/690; 345/89
(58) Field of Search ..... 345/87, 89, 95, 345/204, 690, 208–209, 210

(56) References Cited

U.S. PATENT DOCUMENTS 5,583,532 A 12/1996 Watanabe ..... 345/89
5,640,174 A 6/1997 Kamei et al. ..... 345/89
5,796,379 A * 8/1998 Enomoto et al. ..... 345/89
6,275,207 B1 * 8/2001 Nitta et al. ..... 345/89

FOREIGN PATENT DOCUMENTS

| | | |
|---|---|---|
| JP | 61-4374 | 1/1986 |
| JP | 5-203918 | 8/1993 |
| JP | 7-92937 | 4/1995 |
| JP | 9-68695 | 3/1997 |

* cited by examiner

*Primary Examiner*—Jimmy H. Nguyen
(74) *Attorney, Agent, or Firm*—David C. Conlin; David A. Tucker; Edwards & Angell, LLP

(57) ABSTRACT

An object of the invention is to provide a liquid crystal display device capable of attaining smooth gray scale display and greatly improved display quality, free from the display problems of flicker and the like. The resistance division ratios for gray scale voltage generating resistors provided in the source driver of a source line drive circuit for applying gray scale voltages to pixels via source lines are optimized in accordance with a gray scale display characteristic, and the positive-side voltage resistance division ratios and the negative-side voltage resistance division ratios are set so as to be asymmetrical with one another in consideration of a level shift characteristic.

11 Claims, 15 Drawing Sheets

SOURCE DRIVER, SOURCE LINE DRIVE CIRCUIT, AND LIQUID CRYSTAL DISPLAY DEVICE USING THE SAME

BACKGROUND OF THE INVENTION

1. Field of the Invention

The present invention relates to a source driver for Co generating gray scale voltages supplied to source lines depending on data signals, a source line drive circuit using the source driver, and a matrix display device using the source driver and the source line drive circuit. Particularly, the invention relates to a source driver used for a display device, such as a liquid crystal display device, which is required to be driven by AC voltages because pixels constituting the display screen of the display device may be deteriorated or broken if DC voltages are applied thereto, and the invention also relates to a source line drive circuit using the source driver and to a display device comprising the source driver and the source line drive circuit.

2. Description of the Related Art

In recent years, active-matrix liquid crystal display devices capable of attaining fine display on a large screen have been developed increasingly. In the above-mentioned active-matrix liquid crystal display devices, a configuration wherein a thin-film transistor (TFT) array is formed by a thin-film technology on one of a pair of substrates holding a liquid crystal therebetween has been adopted widely.

FIG. 9 is a circuit diagram showing an example of an equivalent circuit of each pixel in a conventional active-matrix liquid crystal display device. Each pixel is provided corresponding to the intersection of a source line 4 and a gate line 5 disposed so as to be orthogonal to each other as shown in FIG. 9. A TFT formed by using amorphous silicon or the like for example is provided at each pixel, the gate line 5 is connected to the gate electrode of the TFT, and the source line 4 is connected to the source electrode of the TFT. A liquid crystal cell capacitance $C_{LC}$, an auxiliary capacitance $C_S$ and a parasitic capacitance $C_{gd}$ are connected as loads to the drain electrode of the TFT. The above-mentioned parasitic capacitance $C_{gd}$ is generated by the capacitance coupling between the gate line 5 and the drain electrode used as a display electrode. The terminals of the liquid crystal cell capacitance $C_{LC}$ and the auxiliary capacitance $C_S$, not connected to the drain electrode of the TFT, are connected to a common electrode (not shown) on an opposite substrate, and a common electrode voltage $V_{COM}$ is applied to the terminals. In the above-mentioned configuration, a predetermined voltage depending on a data signal is written at the liquid crystal cell capacitance $C_{LC}$ and the auxiliary capacitance $C_S$ during a scanning period, thereby attaining predetermined gray scale display.

When an electric field having a constant direction is kept applied to a liquid crystal for a long time, the liquid crystal deteriorates because of its electrochemical property. For this reason, it is necessary to drive the liquid crystal so that the direction of the electric field to be applied to the liquid crystal is reversed periodically. In a dot inversion system, a gray scale voltage $V_X$ output from a source driver is reversed based on a polarity reversal signal REV so as to be centered with respect to the common electrode voltage $V_{COM}$ and this alternating voltage drives a liquid crystal cell.

The liquid crystal cell voltage $V_{LC}$ generating at the liquid crystal capacitance $C_{LC}$ when the gray scale voltage $V_X$ is applied is a voltage difference between the common electrode voltage $V_{COM}$ and the gray scale voltage $V_X$ supplied from the source line 4 via the source electrode and the drain electrode of the TFT, provided that the effect of the parasitic capacitance $C_{gd}$ is ignored. In actual operation, however, it is impossible to ignore the parasitic capacitance $C_{gd}$.

The effect of the parasitic capacitance $C_{gd}$ upon the drive of the pixel will be described below referring to FIG. 10. FIG. 10 shows the waveform of a scanning voltage $V_Y$ supplied to the gate line 5, the waveform of the gray scale voltage $V_X$ output from the source driver, the waveform of the polarity reversal signal REV, the waveform of the common electrode voltage $V_{COM}$ and the waveform of the liquid crystal cell voltage $V_{LC}$ generated by these voltages at the liquid crystal cell capacitance $C_{LC}$. As shown in FIG. 10, when a selection pulse is applied to the gate electrode of the TFT via the gate line 5, the TFT is turned on. The gray scale voltage $V_X$ applied to the source line 4 is sent from the source electrode via the drain electrode to the liquid crystal cell capacitance $C_{LC}$ and the auxiliary capacitance $C_S$ used as the loads of the TFT. As a result, the liquid crystal cell voltage $V_{LC}$ rises in synchronization with the selection pulse. The voltage at the time when the selection pulse falls (hereinafter referred to as a final writing voltage) is retained by the liquid crystal cell capacitance $C_{LC}$ and the auxiliary capacitance $C_S$. In reality, however, a level shift $\Delta V$ occurs between the final writing voltage and the retaining voltage after the turning off of the TFT because of the effect of the redistribution of charges to the parasitic capacitance $C_{gd}$.

The level shift $\Delta V$ acts to decrease the retaining voltage so that the retaining voltage becomes lower than the final writing voltage in the case where the liquid crystal cell voltage $V_{LC}$ is positive just as in a scanning period $T_1$ shown in FIG. 10. In the case where the liquid crystal cell voltage $V_{LC}$ is negative just as in a scanning period $T_2$, however, the level shift $\Delta V$ acts to increase the retaining voltage so that the retaining voltage becomes higher than the final writing voltage.

As a result, the effective value of the liquid crystal cell voltage $V_{LC}$ in the scanning period $T_1$ differs from that in the scanning period $T_2$, whereby a DC voltage is applied to the liquid crystal, thereby deteriorating the liquid crystal. In addition, since the value of the positive voltage applied to the liquid crystal differs from the value of the negative voltage applied thereto, the luminance of the liquid crystal differs depending on the voltage value, thereby causing flicker in image display. To solve this problem, it has conventionally been proposed that the common electrode voltage $V_{COM}$ should be shifted by the same amount as that of the level shift $\Delta V$ so that the effective value of the positive liquid crystal cell voltage $V_{LC}$ is equal to the effective value of the negative liquid crystal cell voltage $V_{LC}$.

The level shift $\Delta V$ occurs because of the existence of the parasitic capacitance $C_{gd}$ as described above. When the amplitude of the scanning voltage $V_Y$ is $V_G$ the level shift $\Delta V$ is represented by the following expression 1:

$$\Delta V=(C_{gd}/(C_{gd}+C_{LC}+C_S))\cdot V_G \quad (1)$$

When the cell gap is d, the area of the display electrode is A, the specific dielectric coefficient of the liquid crystal material is $\epsilon_{LC}$, and the dielectric coefficient of free space is $\epsilon_0$, the liquid crystal cell capacitance $C_{LC}$ is represented by the following expression 2:

$$C_{LC}=(\epsilon_{LC}\cdot\epsilon_0/d)\cdot A \quad (2)$$

The specific dielectric coefficient $\epsilon_{LC}$ of the liquid crystal material changes depending on the arrangement state of liquid crystal molecules, that is, depending on the liquid crystal cell voltage $V_{LC}$. Therefore, the liquid crystal cell capacitance $C_{LC}$ is given as a function f1 of the liquid crystal cell voltage $V_{LC}$ and represented by the following expression 3. $K_1$ is a constant.

$$C_{LC}=K_1 \cdot f1 \quad (3)$$

Therefore, the level shift ΔV is also given as a function f2 of the liquid crystal cell voltage $V_{LC}$ and represented by the following expression 4.

$K_2$ is a constant.

$$\Delta V=K_2 \cdot f2(V_{LC}) \quad (4)$$

Furthermore, the light transmittance of the liquid crystal changes nonlinearly with respect to the magnitude of the liquid crystal cell voltage $V_{LC}$. In other words, since the effective value of the liquid crystal cell voltage $V_{LC}$ differs at each gray scale level when attaining gray scale display, it is found that the magnitude of the level shift ΔV at each gray scale level is not constant. Therefore, it is necessary to correct the level shift ΔV at each gray scale level.

First, the general configuration of a conventional active-matrix liquid crystal display device will be described below. As shown in FIG. 11, the conventional active-matrix liquid crystal display device comprises a pixel array 1 having a plurality of pixels arranged in matrix, a liquid crystal panel having a plurality of source lines (not shown) and a plurality of gate lines (not shown) disposed orthogonal to one another, a source line drive circuit 8 for driving the source lines, and a gate driver 3 for driving the gate lines.

The source line drive circuit 8 is provided with a source driver 2 and a plurality of reference voltage generation circuits 9 (for positive and negative voltages) for supplying reference voltages to the source driver 2. The output voltage generation portion of the source driver 2 comprises a gray scale voltage generation circuit (not shown), a gray scale selection circuit (not shown) and an output buffer (not shown). The positive reference voltages and the negative reference voltages generated by the positive (High) reference voltage generation circuits and the negative (Low) reference voltage generation circuits respectively are supplied to the gray scale voltage generation circuit via the gray scale voltage input terminals of the source driver 2.

The gray scale voltage generation circuit is provided with a resistance-type voltage division circuit comprising a plurality of resistors connected in series. The voltage between the positive and negative reference voltages is equally divided by the resistance-type voltage division circuit to generate a plurality of output gray scale voltages. One of the generated a plurality of gray scale voltages is selected by the selection circuit depending on output gray scale data and output to the source line 4 of the liquid crystal panel via the output buffer.

At this time, the level shift ΔV is present as described above. Therefore, it is necessary to carry out a correction (hereinafter referred to as the correction of the ΔV characteristic). In order to ideally correct the level shift ΔV characteristic with respect to the voltage applied to the liquid crystal, a proper gray scale voltage should be applied for each gray scale voltage. However, if all gray scale voltages are input to the source driver 2, the circuit is required to be very large in size, and this is not practical. For this reason, about five positive reference voltages and about five negative reference voltages are usually supplied to the reference voltage input terminals of the source driver 2. The voltage between reference voltages adjacent to each other is equally divided by the series resistors of the gray scale voltage generation circuit inside the source driver 2 in order to reduce the deviation of ΔV.

The conventional source driver is provided with a plurality of reference voltage input terminals connected to the gray scale voltage generation circuit disposed inside the source driver, and the resistance value between the input terminals adjacent to each other is equally divided to generate still more gray scale voltages. In addition, the positive gray scale voltage generation series resistors are made symmetrical with the negative gray scale voltage generation series resistors inside the source driver. For this reason, in the case where the highest-level voltage and the lowest-level voltage are supplied only to the highest-level and lowest-level reference voltage input terminals respectively, the positive gray scale voltage and the negative gray scale voltage at each gray scale level are generated so as to be vertically symmetrical with each other. However, a level shift ΔV being different at each gray scale level is present at the time of driving the liquid crystal as described above, and the ΔV characteristic must be corrected. For this purpose, asymmetric voltage values in consideration of the ΔV are usually supplied to the about five positive reference voltage input terminals and the about five negative reference voltage input terminals of the source driver as described above. The voltage between the voltages adjacent to each other is equally divided by the series resistors of the gray scale voltage generation circuit inside the source driver in order to reduce the deviation of ΔV.

There are generally two reasons for the supply of a plurality of reference voltages from outside to the source driver. A first reason is to attain smooth gray scale display, and a second reason is to optimize the correction of the level shift ΔV characteristic.

The first reason will be described below. The gray scale voltage generation circuit inside the source driver comprises series resistors divided equally, and voltages are usually supplied from outside so as to conform to the characteristic of an image. However, in the case where the number of input points is scarce, the luminance change between the reference inputs adjacent to each other becomes linear in the characteristic with respect to gray scale and luminance because of the equal division. For this reason, the luminance change does not become smooth as shown in the solid lines of FIG. 12. The solid lines of FIG. 12 show the characteristic with respect to gray scale and luminance for the conventional source driver Each plot point is a point wherein a gray scale voltage is input. FIG. 12 shows a case where five gray scale voltages are input from outside. The broken line of FIG. 12 shows an ideal characteristic with respect to gray scale and luminance on the assumption that all gray scale levels are displayed smoothly in the case of 64 gray scale levels. However, in the conventional case where the number of gray scale voltage input points is scarce, that is, about five, the luminance changes linearly as shown in the solid lines of FIG. 12, whereby it is impossible to obtain an ideal characteristic with respect to gray scale and luminance. This kind of technology for improving the characteristic with respect to gray scale and luminance by providing a plurality of reference points has been described in Japanese Unexamined Patent Publication JP-A 61-4374 (1986) for example.

Next, the second reason will be described below. FIG. 13 shows the center value (the average value of the positive and negative voltages) of the output voltage and the level shift ΔV characteristic in the case of the conventional driver wherein the resistance values inside the source driver are equally divided between the reference voltages. The abscissa represents gray scale, and the ordinate represents voltage, The curve 32 of FIG. 13 indicates the level shift ΔV characteristic at each gray scale voltage. The broken line 31 indicates the center value of the source driver generation voltage at the time when the voltage between the reference voltages is equally divided. If the broken line 31 coincides with the curve 32, no DC voltage is applied to the liquid crystal, and the liquid crystal is AC-driven properly. However, if the reference voltages are input sparsely as described above, a voltage generated by equal-division resistors is output as indicated by the broken line 31 at a gray scale level other than the gray scale levels wherein optimum reference voltages in consideration of the level shift ΔV are input. Therefore, the ΔV characteristic is not corrected sufficiently, and the output voltage deviates from the voltage based on the proper ΔV characteristic by Va. If the amount of this deviation is large, AC-drive is not carried out optimally, and a DC voltage is applied to the liquid crystal, thereby not only causing the deterioration of the liquid crystal but also causing the problems of flicker and image persistence.

The above-mentioned two problems significantly lower the performance of the display device. In order to improve the quality of the display, numerous reference voltage input points become necessary. However, the number of the reference voltage input points is limited because of the size of the circuit and the like. Usually, about five points at most are provided for both the positive and the negative reference values. Even in this case, since the resistance value between the reference voltages is equally divided inside the source driver, the ΔV characteristic cannot be corrected precisely as described above, and a DC voltage is applied to the liquid crystal. In addition, the change ratio in luminance ahead of and behind the reference voltage input point changes abruptly. Therefore, in the case where gray scale ramp display (display of an image linearly changing from white to black) is carried out, unnatural luminance change is recognized definitely.

Furthermore, in the conventional technology, in order to correct the ΔV characteristic, a variable resistor for changing the potential of the common electrode is provided in a common electrode drive circuit. The resistance value of the variable resistor is adjusted so that flicker is reduced at any given gray scale points by carrying out visual checking or image recognition of a flicker evaluation pattern at each gray scale level, whereby the common electrode voltage $V_{COM}$ is set close to a proper value.

However, in the conventional technology wherein the voltage between the external reference voltages is equally divided by the resistance-type division circuit inside the source driver, the voltages obtained by the correction of the level shift ΔV do not completely conform to the proper voltages at all gray scale levels as shown in FIG. 13. Therefore, even if the common electrode potential $V_{COM}$ is adjusted so that no flicker appears at a certain gray scale level, the positive liquid crystal cell voltage $V_{LC}$ and the negative liquid crystal cell voltage $V_{LC}$ have values different from each other at other gray scale levels, and flicker occurs at the voltages at those gray scale levels, thereby impairing the quality of display. In addition, the adjustment of the common electrode potential $V_{COM}$ is very difficult and takes time.

Furthermore, Japanese Unexamined Patent Publication JP-A 7-92937 (1995) discloses a liquid crystal display device drive method capable of preventing an afterimage phenomenon while attaining multi-level gray scaling. In this method, a gray scale voltage generation circuit for supplying gray scale voltages to a source driver is provided outside the source driver, the addition voltage $+V_1$ and the subtraction voltage $-V_1$ of a maximum amplitude voltage $V_S$ and a reference voltage $V_C$ are alternately supplied by an alternating signal to both the end terminals of a resistance-type voltage division circuit formed in a gray scale voltage generation circuit to generate a plurality of gray scale voltages as shown in FIG. 14. Furthermore, an intermediate voltage $V_{SSC}$ supplied to the intermediate point of the resistance-type voltage division circuit is shifted from the reference voltage $V_C$ as shown in FIG. 15A and FIG. 15B, whereby asymmetrical positive and negative gray scale voltages are output, and the center value of each gray scale voltage is set optimally with respect to the voltage of the common electrode.

However, in the case where N-level gray scale display is carried out by the drive method disclosed by the above-mentioned publication, the resistance-type voltage division circuit in the gray scale voltage generation circuit is required to be divided by N resistors for both the positive and negative voltages in order to optimally set the center values of all gray scale values. This makes the circuit large in size and increases production cost and power consumption, thereby being impractical. More particularly, when 64-level gray scale display is carried out when the difference between the highest-level reference voltage and the lowest-level reference voltage is 10 V for example, a voltage accuracy of about 5 mV is required in the intermediate gray scale display region wherein the accuracy should be highest in order to attain accurate gray scale display. To attain this, a resistance value accuracy of 0.05% is required. It is thus necessary to use resistors having an accuracy far higher than the resistance accuracy (1%) of resistors usually used as discrete resistors outside the source driver. In other words, it is impractical to attain such a high accuracy by using discrete resistors. Furthermore, if a circuit requiring such a high voltage accuracy is formed by using discrete components outside the source driver and voltage division is carried out, the problem of unstable voltage division values because of external noise from a backlight for example occurs, whereby the accuracy of the voltage values is low, and accurate gray scale display cannot be attained.

SUMMARY OF THE INVENTION

An object of the invention is to provide a liquid crystal display device capable of attaining smooth gray scale display and greatly improved display quality, free from problems such as flicker, image persistence and the like.

The invention relates to a source driver for supplying gray scale voltages depending on data signals, to pixels required to be AC-driven, comprising a resistance-type voltage division circuit for generating gray scale voltages, wherein positive-side (high level) voltage resistance division ratios and negative-side (low level) voltage resistance division ratios of the resistance-type voltage division circuit are set so as to be asymmetrical with one another depending on level shift characteristics.

In accordance with the invention, the plurality of positive-side voltage resistance division ratios and negative-side voltage resistance division ratios of the resistance-type voltage division circuit provided in the source driver to generate gray scale voltages are set so as to be asymmetrical with one another in consideration of the nonlinear characteristic of the level shift ΔV because of the anisotropy of the dielectric coefficient of the liquid crystal. Therefore, the correction of the level shift ΔV characteristic can be carried out at each gray scale level, whereby the positive-side liquid crystal cell voltage $V_{LC}$ can be made equal to the negative-side liquid crystal cell voltage $V_{LC}$ at each gray scale level. In other words, an unnecessary DC voltage is not applied to the molecules of the liquid crystal, whereby image persistence does not occur, the display problem of flicker and the like can be solved and the quality of display can be improved greatly. Furthermore, all gray scale voltages are corrected completely in consideration of the level shift ΔV. Therefore, at the time of the visual adjustment of a common electrode voltage $V_{COM}$ by using a flicker evaluation pattern at each gray scale level, by just adjusting the common electrode $V_{COM}$ so that flicker disappears at a given gray scale level, it is possible to completely solve the display problems of flicker and the like at all the gray scale levels. For this reason, the adjustment of the common electrode voltage $V_{COM}$ can be carried out very easily, with the result that the operation time is shortened.

Furthermore, the invention relates to a source driver for supplying gray scale voltages depending upon data signals, to pixels required to be AC-driven, comprising a resistance-type voltage division circuit for generating gray scale voltages, wherein resistance ratios of the resistance-type voltage division circuit are optimized depending on gray scale display characteristics. In particular, the resistance division ratios of the resistance-type voltage division circuit respectively constitute the ratios of the resistances of the series-connected resistors of the resistance-type voltage division circuit present between each adjacent pair thereof in order to generate each of the desired gray scale voltages, i.e., those resistance ratios required for generating the desired level shift compensated voltage divisions between a positive-side highest-level gray scale reference voltage and a negative-side lowest-level gray scale voltage by the resistors of the resistance-type voltage division circuit.

In accordance with the invention, the plurality of resistance division ratios of the resistance-type voltage division circuit provided in the source driver to generate gray scale voltages can be made highly accurate and can conform to a target γ characteristic (gray scale display characteristic) by IC (integrated circuit) formation. Therefore, the source driver of the invention can output liquid crystal application voltages for attaining smooth gray scale display having an ideal γ characteristic.

Furthermore, the invention relates to a source line drive circuit for supplying gray scale voltages depending on data signals, to pixels required to be AC-driven, comprising the above-mentioned source driver and a gray scale reference voltage generation circuit, wherein the source driver is provided with a plurality of input terminals, to which a plurality of input terminals are supplied gray scale reference voltages each having a different voltage level, and positive-side and negative-side gray scale voltages are generated based on the plurality of gray scale reference voltages.

In accordance with the source line drive circuit of the invention, the resistance division ratios of the resistance-type voltage division circuit for generating gray scale voltages are set as described above. Therefore, unlike the case of the conventional source line drive circuit, pixels can be driven optimally without supplying gray scale reference voltages having numerous levels. As a result, it is possible to eliminate a gray scale reference voltage generation circuit to be provided outside the source driver of the source line drive circuit. Therefore, the overall size of the source line drive circuit can be made smaller, the cost of components can be reduced, and lower power consumption can be attained.

Furthermore, the invention relates to a source line drive circuit for supplying gray scale voltages depending on data signals, to pixels required to be AC-driven, comprising the above-mentioned source driver, wherein the source driver is provided with two input terminals, to one of which input terminals is supplied a positive-side highest-level reference voltage and to the other of which input terminals is supplied a negative-side lowest-level reference voltage, and positive-side and negative-side gray scale voltages are generated based on the highest-level reference voltage and the lowest-level reference voltage.

In accordance with the invention, the source line drive circuit supplies the positive-side highest-level reference voltage and negative-side lowest-level reference voltage to the source driver. By using the reference voltages, the resistance-type voltage division circuit inside the source driver can generate all positive-side and negative-side gray scale voltages accurately and properly. It is thus not necessary to provide a gray scale reference voltage generation circuit outside the source driver. Therefore, the overall size of the source line drive circuit can be made smaller, the cost of components can be reduced, and lower power consumption can be attained.

Furthermore, the invention relates to an active-matrix liquid crystal display device comprising a plurality of pixels disposed in matrix, a plurality of data signal lines disposed corresponding to columns of the pixels, a plurality of scanning signal lines disposed corresponding to rows of the pixels, switching devices at the individual pixels, and the above-mentioned source line drive circuit for driving the data signal lines.

In accordance with the active-matrix liquid crystal display device of the invention, the positive-side voltage resistance division ratios and negative-side voltage resistance division ratios of the resistance-type voltage division circuit provided in the source driver to generate gray scale voltages are set so as to be asymmetrical with one another. Therefore, the level shift ΔV being different depending on each gray scale voltage is reflected to the resistance division ratios of the resistance-type voltage division circuit inside the source driver to correct the gray scale voltages. For this reason, it is possible to obtain an active-matrix liquid crystal display device capable of solving the display problem of flicker and the like and having greatly improved quality of display.

Furthermore, it is possible to generate ideal, highly accurate gray scale voltages conforming to the target γ characteristic without supplying numerous external gray scale reference voltages to the source driver, unlike the case of the conventional source line drive circuit. Therefore, the gray scale reference voltage generation circuit provided outside the source driver can be made smaller. Therefore, the overall size of the source line drive circuit can be made smaller, the cost of components can be reduced, and lower power consumption can be attained.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
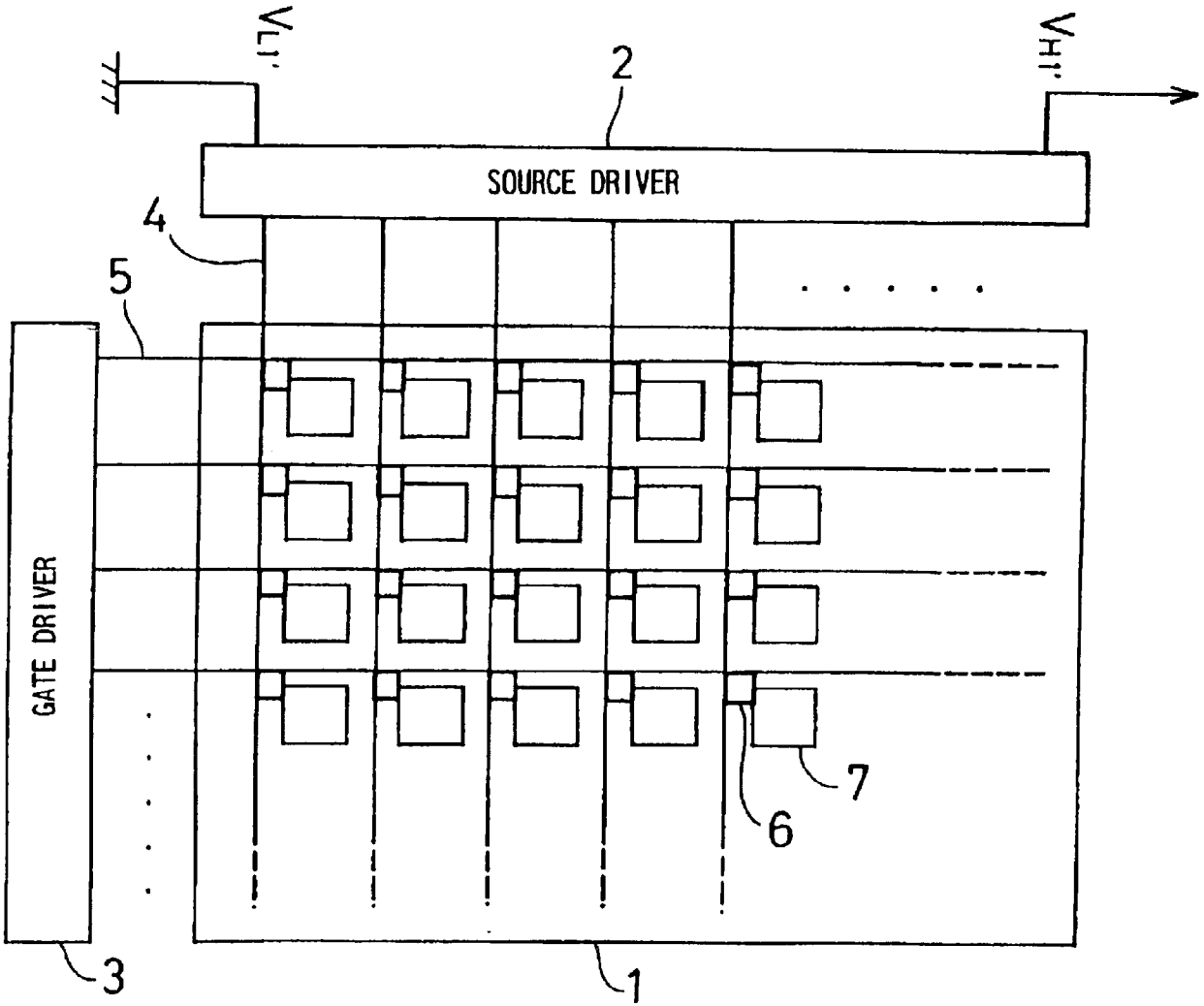
FIG. 1 is a view showing a general configuration of an active-matrix liquid crystal display device in accordance with the invention.

Now referring to the drawings, preferred embodiments of the invention are described below.

First, the general configuration of an active-matrix liquid crystal display device in accordance with the invention will be described below. As shown in FIG. 1, the active-matrix liquid crystal display device comprises a plurality of source lines 4 (data lines) and a plurality of gate lines 5 disposed so as to be orthogonal to one another, a pixel array 1, a source driver 2 for driving the source lines 4, and a gate driver 3 for driving the gate lines 5. A circuit for generating gray scale voltages is shown as the source driver 2 in the center of FIG. 1. A circuit for inputting data signals, a timing control circuit, etc. are not shown in FIG. 1.

The pixel array 1 is formed of pixels 7, each of which is provided in a region enclosed with two adjacent source lines 4 and two adjacent gate lines 5. In other words, the pixels 7 are arranged in matrix on the whole to form the pixel array 1.

A liquid crystal cell capacitance $C_{LC}$, an auxiliary capacitance $C_S$ and a parasitic capacitance $C_{gd}$ are connected to the drain electrode of a TFT 6 as loads. The parasitic capacitance $C_{gd}$ is generated by the capacitance coupling of the gate line 5 and the drain electrode used as a display electrode. Out of the terminals of the liquid crystal cell capacitance $C_{LC}$ and auxiliary capacitance $C_S$, ones which are not connected to the drain electrode of the TFT 6, are connected to a common electrode (not shown) of an opposite substrate, and a common electrode voltage $V_{COM}$ is applied to the terminals.

With the above-mentioned configuration, a predetermined voltage depending on a video signal is retained during one scanning period at the liquid crystal cell capacitance $C_{LC}$ and the auxiliary capacitance $C_S$, whereby predetermined gray scale display can be attained at the pixel 7. A liquid crystal cell voltage $V_{LC}$ generating at the liquid crystal capacitance $C_{LC}$ when a gray scale voltage $V_X$ is applied is a voltage difference between the common electrode voltage $V_{COM}$ and the gray scale voltage $V_X$ supplied from the source line 4 via the source electrode and the drain electrode of the TFT 6, provided that the effect of the parasitic capacitance $C_{gd}$ is ignored.

(Embodiment 1)

Figure 2:
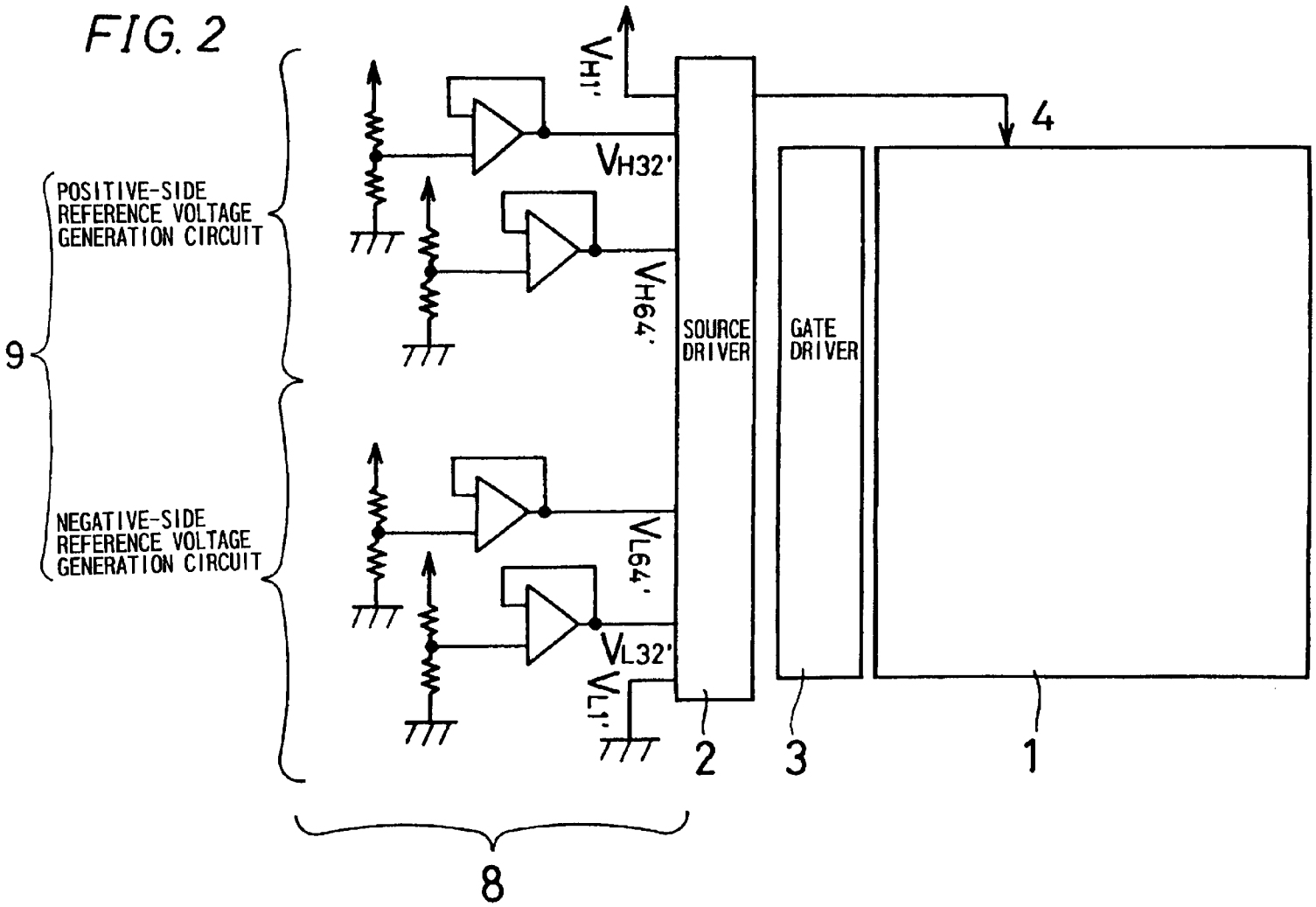
FIG. 2 is a view showing a general configuration of an active-matrix liquid crystal display device in accordance with embodiment 1 of the invention.

FIG. 2 shows an active-matrix liquid crystal display device for 64-level gray scale display. In embodiment 1, as shown in FIG. 2, a source line drive circuit 8 has a source driver 2, and gray scale reference voltage generation circuit 9 is provided outside the source driver 2.

Figure 3:
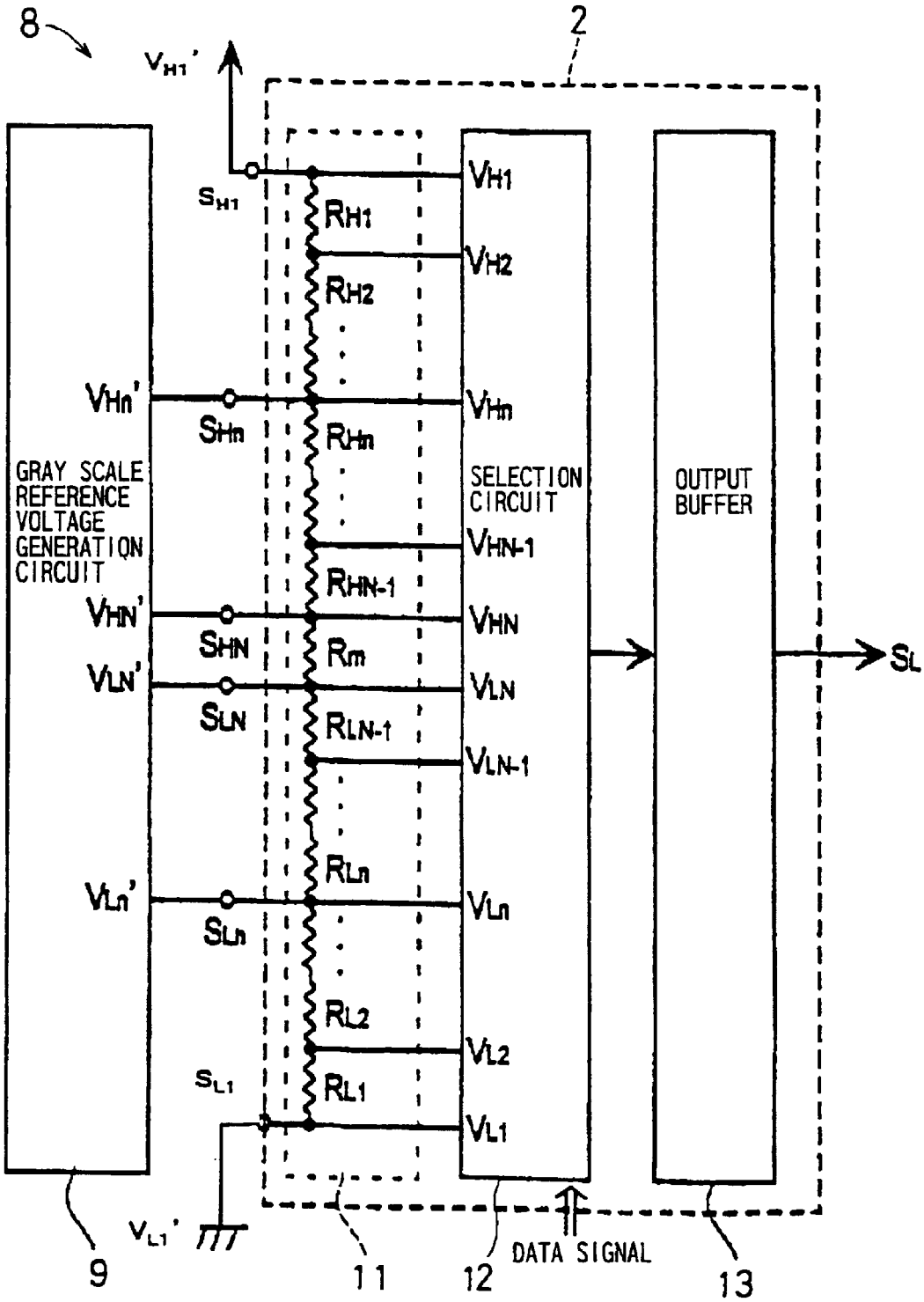
FIG. 3 is a block diagram showing the configuration of a source driver in accordance with the embodiment 1 of the invention.

As shown in FIG. 3, the source driver 2 has a plurality of gray scale reference input terminals $S_{M1}$, $S_{Mn}$, $S_{NM}$, $S_{LN}$, $S_{Ln}$ and $S_{L1}$, and includes a gray scale voltage generation circuit 11, a selection circuit 12 and an output buffer 13 being formed in an IC (integrated circuit). Gray scale reference voltages generated by an external power source (not shown) and the gray scale reference voltage generation circuit 9 are supplied to the input terminals of the source driver, and the gray scale reference voltages are divided by resistors at the gray scale voltage generation circuit 11, whereby more gray scale voltages are generated. The gray scale voltage corresponding to a data signal is selected by the selection circuit 12 and output to the source line 4 via the output buffer 13

The gray scale voltage generation circuit 11 of the source driver 2 is a resistance-type voltage division circuit comprising a plurality of resistors connected in series. In the case of N-level gray scale display for example, 2N-1 resistors are provided in series between the input terminals $S_{H1}$ and $S_{L1}$ in the order of $R_{M1}$, $R_{B2}$, . . . , $R_{Hn}$, . . . , $R_{HN-1}$, $R_M$, $R_{LN-1}$, . . . , $R_{Ln}$, and $R_{L1}$.

A positive-side highest-level gray scale reference voltage $V_{H1}'$ generated by the external power source is supplied to the input terminal $S_{H1}$, and a negative-side lowest-level gray scale reference voltage $V_{L1}'$ generated by the external power source is supplied to the input terminal $S_{L1}$. A positive-side reference voltage $V_{Hn}'$ generated by the gray scale reference voltage generation circuit 9 is supplied to the input terminal $S_{Hn}$, and a positive-side reference voltage $V_{HN}'$ generated by the gray scale reference voltage generation circuit 9 is supplied to the input terminal $S_{HN}$. A negative-side reference voltage $V_{Ln}'$ generated by the gray scale reference voltage generation circuit 9 is supplied to the input terminal $S_{Ln}$, and a negative-side reference voltage $V_{LN}'$ generated by the gray scale reference voltage generation circuit 9 is supplied to the input terminal $S_{LN}$.

The positive-side highest-level gray scale reference voltage $V_{H1}'$ supplied to the input terminal $S_{H1}$ is supplied to the selection circuit 12 as a positive-side first gray scale voltage $V_{H1}$. The negative-side lowest-level gray scale reference voltage $V_{L1}'$ supplied to the input terminal $S_{L1}$ is supplied to the selection circuit 12 as a negative-side first gray scale voltage $V_{L1}$. A positive-side second gray scale voltage $V_{M2}$ generates at the intersection of the resistors $R_{H1}$ and $R_{M2}$ depending on the resistance division ratio of the resistance-type voltage division circuit. In the same way, a positive-side nth gray scale voltage $V_{Hn}$ generates at the intersection of the resistors $R_{HN-1}$, and $R_{Hn}$, and a positive-side Nth gray scale voltage $V_{HN}$ generates at the intersection of the resistors $R_{HN-1}$ and $R_m$. In the same way, a negative-side second gray scale voltage $V_{L2}$ generates at the intersection of the resistors $R_{L1}$ and $R_{L2}$, a negative-side nth gray scale voltage $V_{Ln}$ generates at the intersection of the resistors $R_{Ln+1}$ and $R_{Ln}$, and a negative-side Nth gray scale voltage $V_{LN}$ generates at the intersection of the resistors $R_{LN-1}$ and $R_m$.

At this time, the resistance division ratios of the gray scale voltage generation circuit 11 must be set properly in order to generate gray scale voltages which have been completely subjected to the correction of the level shift ΔV characteristic at all gray scale levels.

In order to make the positive-side liquid crystal cell voltage $V_{LC}$ equal to the negative-side liquid crystal cell voltage $V_{LC}$ at all gray scale levels, the center value of the source output voltage $(V_{Hn}+V_{Ln})/2$, must equal the common electrode voltage $V_{COM}$ determined in consideration of the ΔV characteristic at each gray scale level. In other words, since the level shift ΔV characteristic is not constant at all gray scale levels, the output voltage of the source driver at each gray scale level must be set so as to be vertically asymmetrical. Setting the output voltage so as to be asymmetrical means that the potential difference between the positive-side nth gray scale voltage $V_{Hn}$ and the common electrode voltage $V_{COM}$ is made different from the potential difference between the negative-side nth gray scale voltage $V_{Ln}$ and the common electrode voltage $V_{COM}$.

Figure 4:
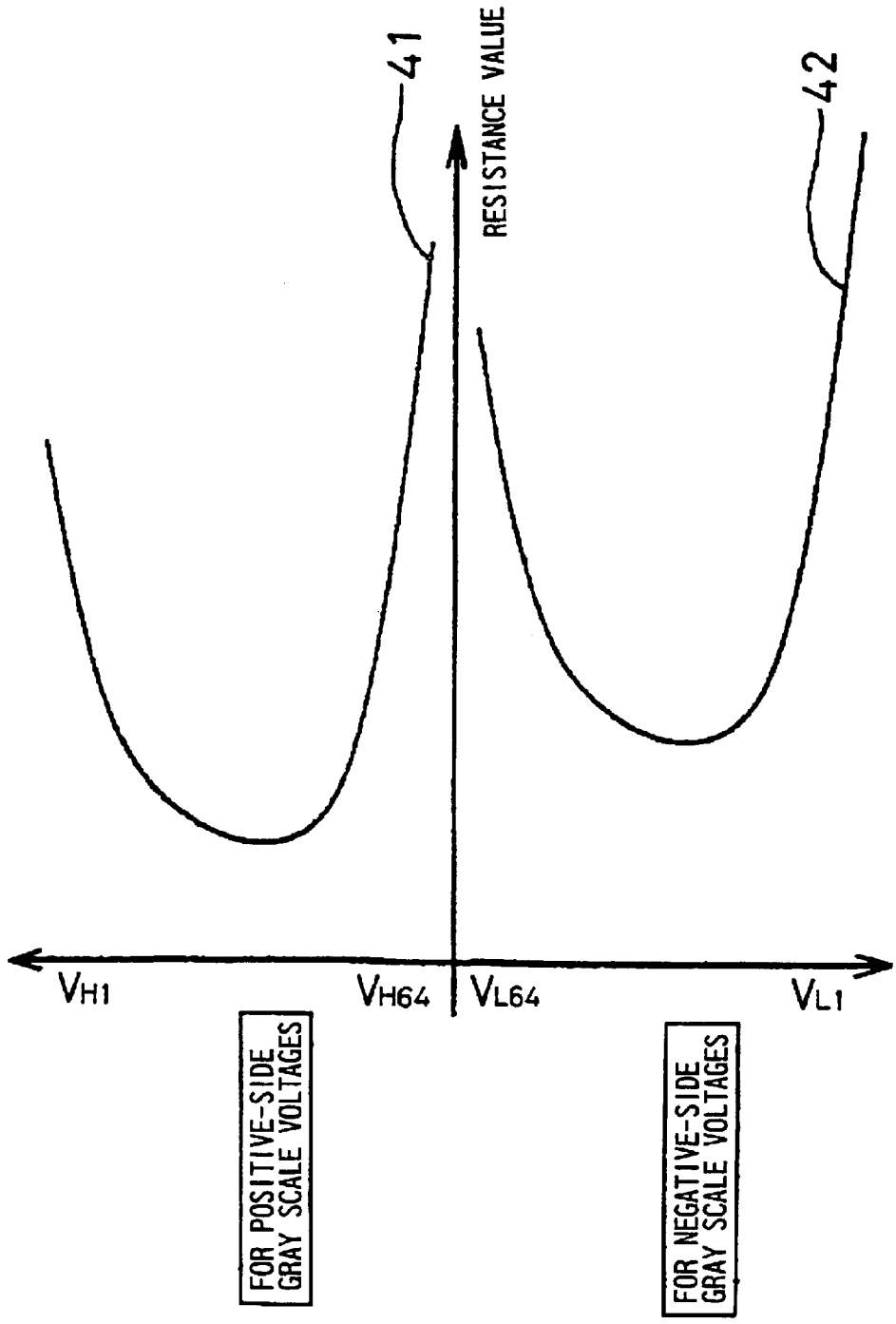
FIG. 4 is a graph showing the resistance values of the resistance-type voltage division circuit inside the source driver in accordance with the embodiment 1 of the invention.

FIG. 4 shows setting examples of resistance values of individual series resistors wherein the resistance values are set so that the correction of the level shift ΔV characteristic can be carried out completely at the resistance-type voltage division circuit, that is, the gray scale voltage generation circuit 11 inside the source driver 2 in the case of 64-level gray scale display. A curve 41 indicates the resistance values of 63 series resistors $R_{H1}$, $R_{H2}$, . . . , $R_{Hn}$, . . . and $R_{H63}$ for generating positive-side gray scale voltages $V_{H1}$, $V_{H2}$, . . . and $V_{H64}$. A curve 42 indicates the resistance values of 63 series resistors $R_{L1}$, $R_{L2}$, . . . , $R_{Ln}$, . . . and $R_{L63}$ for generating negative-side gray scale voltages $V_{L1}$, $V_{L2}$, . . . and $V_{L64}$. As shown in FIG. 4, the resistance values of the series resistors for generating the positive-side gray scale voltages are set vertically asymmetrical with the resistance values of the series resistors for generating the negative-side gray scale voltages in consideration of the correction of the level shift ΔV characteristic.

In the embodiment 1, as shown in FIG. 2, to perform 64-level gray scale display, two-level positive-side gray scale reference voltages $V_{H32}'$ and $V_{H64}'$ and two-level negative-side gray scale reference voltages $V_{L32}'$ and $V_{L64}'$ are generated by the gray scale reference voltage generation circuit and supplied to the input terminals $S_{H32}$, $S_{H64}$, $S_{L32}$ and $S_{L64}$ of the source driver respectively.

Figure 5:
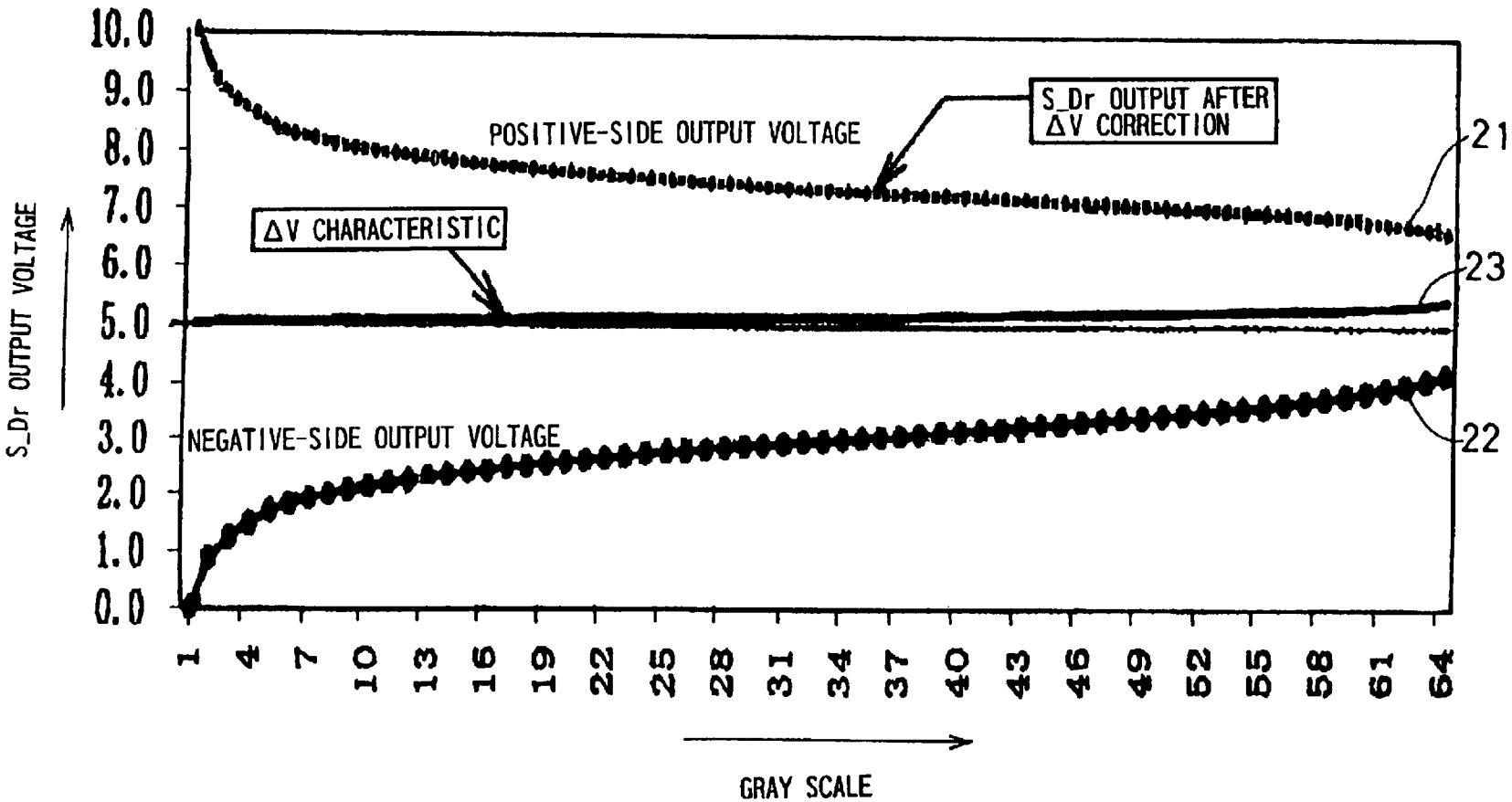
FIG. 5 is a graph showing the output voltages to the positive-side and negative-side source lines at all gray scale levels in accordance with the embodiment 1 of the invention.
Figure 6:
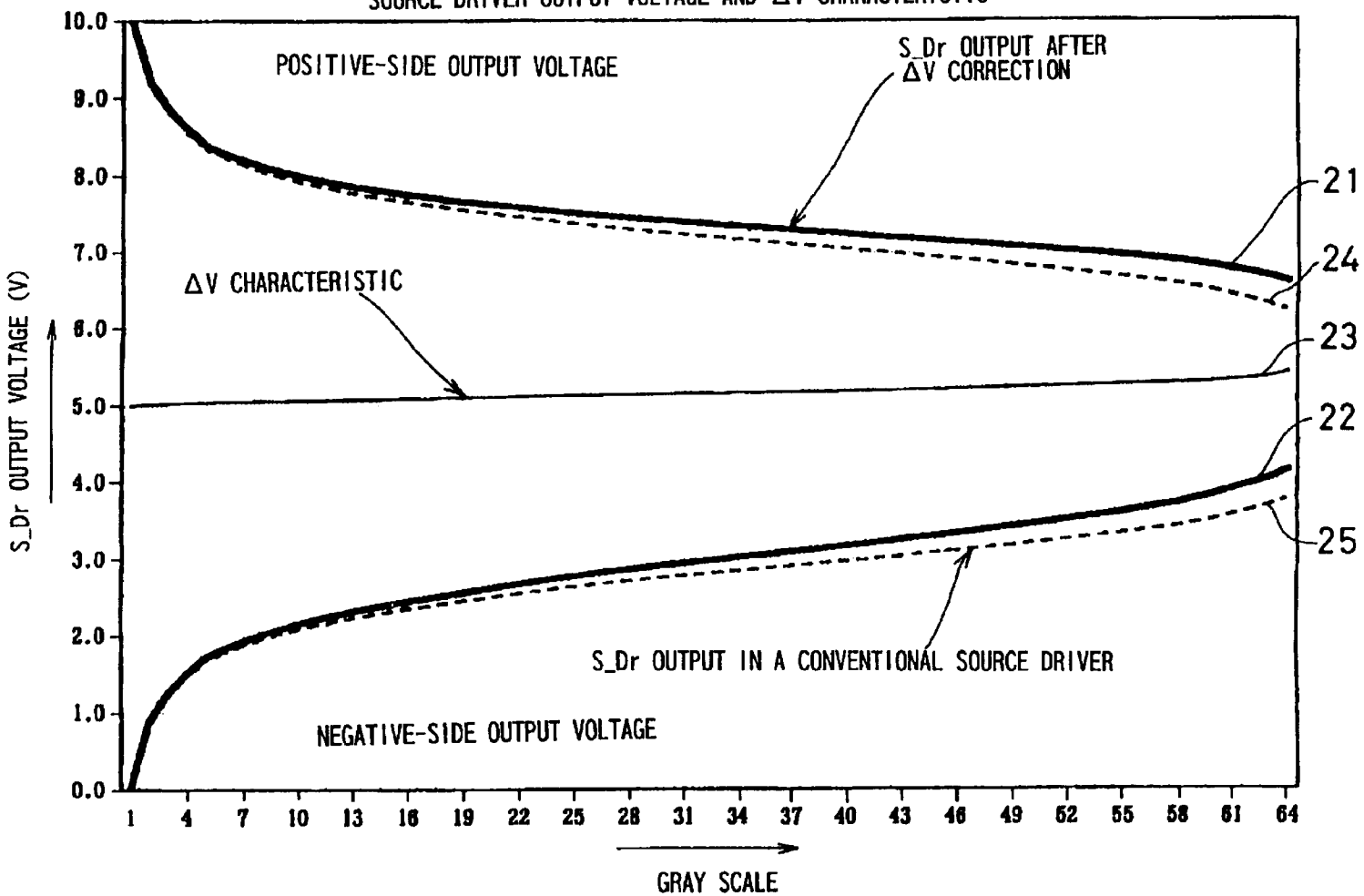
FIG. 6 is a graph showing the output voltages to the positive-side and negative-side source lines at all gray scale levels in accordance with the embodiment 1 of the invention.

FIG. 5 shows the positive-side and negative-side output voltages generated by the resistance-type voltage division circuit of the source driver 2 of the present embodiment and output to the source lines for all gray scale levels. Furthermore, FIG. 6 is a magnified view of FIG. 5. FIGS. 5 and 6 show the case of 64-level gray scale display. In addition, FIG. 6 shows the level shift ΔV depending on the gray scale voltage and also shows the output voltages to the source lines in the case of using the conventional source driver. In FIGS. 5 and 6, the abscissa represents gray scale and the ordinate represents output voltage. In FIGS. 5 and 6, the curve 21 indicates the positive-side output voltages to the source lines at all gray scale levels in the present embodiment. The curve 22 indicate the negative-side output voltages to the source ko lines at all gray scale levels in the present embodiment. The curve 23 represents the level shift ΔV depending on the gray scale voltage (ΔV characteristic). Furthermore, the curve 24 of FIG. 6 indicates the positive-side output voltages to the is source lines at all gray scale levels in the conventional source driver. The curve 25 indicates the negative-side output voltages to the source lines at gray scale levels in the conventional source driver. FIGS. 5 and 6 show a case where the positive-side output of the source driver at the gray scale level 1 is +10 V, the negative-side output of the source driver at the gray scale level 1 is 0 V, and the center voltage is +5 V.

It is found that the level shift ΔV increases as the gray scale level becomes higher, that is, the level shift ΔV increases about +0.4 V in the range from the gray scale level 1 to the gray scale level 64. It is also found that the level shift ΔV changes nonlinearly depending on the gray scale voltage. In the present embodiment, the gray scale voltages of the source driver are generated in consideration of the dependence of the level shift ΔV on the gray scale voltage at each gray scale level. Therefore, the curve 21 of the positive-side output voltages to the source lines is symmetrical with the curve 22 of the negative-side output voltages to the source lines with respect to the level shift ΔV characteristic curve 23. For this reason, the positive-side liquid crystal cell voltage $V_{LC}$ and the negative-side liquid crystal cell voltage $V_{LC}$ can be made equal to each other at each gray scale level, thereby not causing the problem of flicker and the like.

Figure 13:
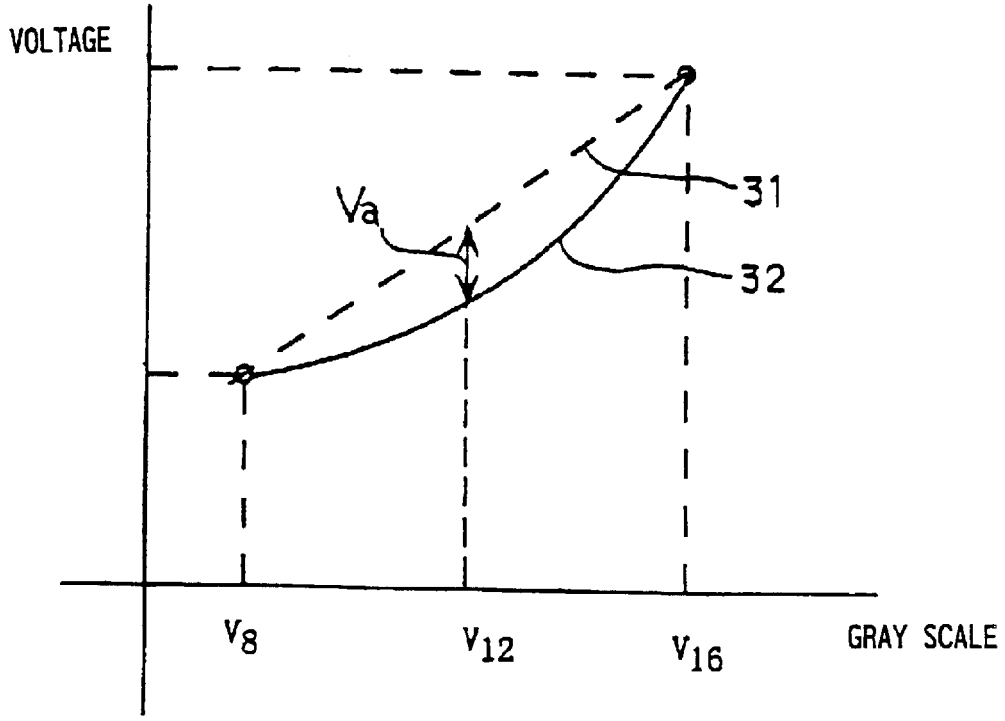
FIG. 13 Prior Art
FIG. 13 is a graph showing a level shift ΔV and a center value of the output voltage in the case where a source driver of a conventional active-matrix type liquid crystal display device is used.
Figure 14:
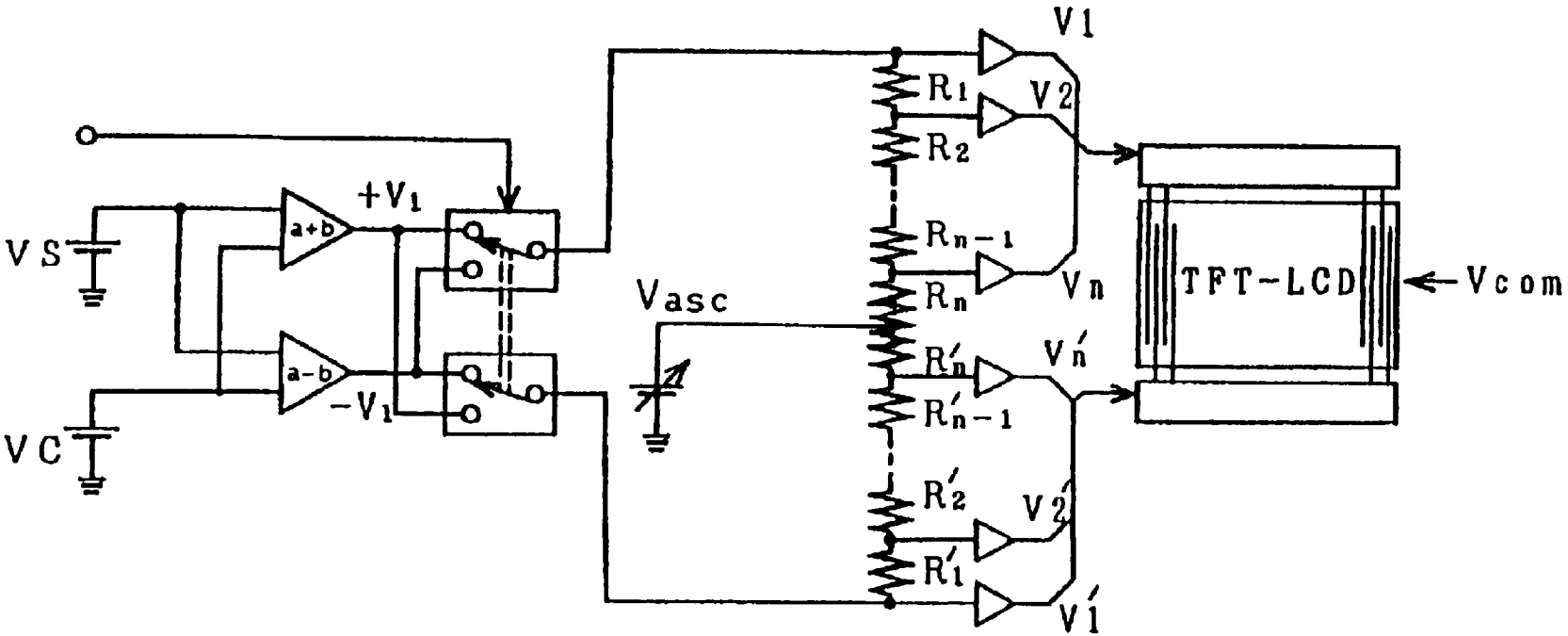
FIG.14 Prior Art
FIG. 14 is a view showing a general configuration of a second conventional active-matrix liquid crystal display device.
Figure 15A:
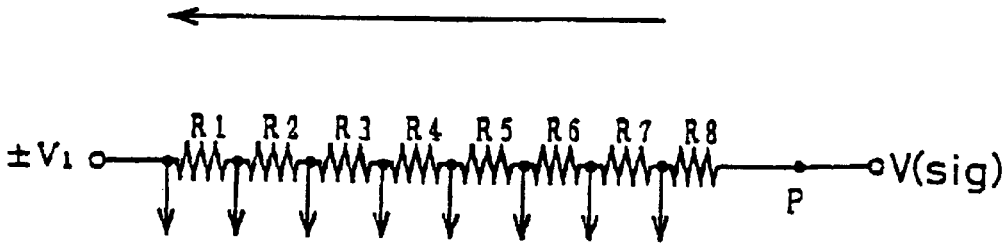
FIG.15A Prior Art
FIG. 15A and FIG. 15B are views illustrating a liquid crystal drive method for the second conventional active-matrix liquid crystal display device.
Figure 15B:
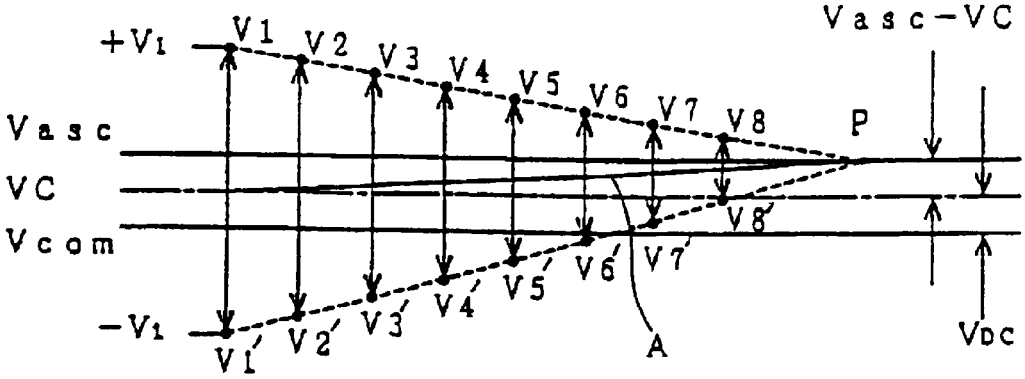
FIG.15B Prior Art

On the other hand, in the case of the conventional technology, the positive-side and negative-side output voltages are symmetrical with each other with respect to only the center voltage, +5 V, at each gray scale level as indicated by the curves 24 and 25. As a result, an unnecessary DC voltage is applied to the liquid crystal, thereby deteriorating the liquid crystal or causing the problem of flicker. Furthermore, in the conventional technology, about five positive-side gray scale reference voltages and about five negative-side gray scale reference voltages for example are supplied from an external circuit to the source driver in order to reduce the deviation of the correction of the level shift Δv characteristic. In reality, however, a deviation Va from a target voltage occurs as shown in FIG. 13. If the Va becomes large, the problem of flicker occurs.

In the present embodiment, in consideration of the dependence of the level shift ΔV on the gray scale voltage, the positive-side voltage resistance division ratios and negative-side voltage resistance division ratios of the resistance-type voltage division circuit inside the source driver are set so as to be asymmetrical with one another. Therefore, voltages can be output in accordance with the level shift ΔV characteristic as indicated by the curves 21 and 22 shown in FIGS. 5 and 6. Furthermore, by the above-mentioned setting of the resistance division ratios, the source line drive circuit having the source driver in accordance with the present embodiment can generate gray scale voltages, the center values of which have the characteristic indicated by the curve 32 of FIG. 13. Therefore, the deviation of the correction of the level shift ΔV characteristic does not occur, thereby completely solving the display problem of flicker and the like.

By optimally incorporating the resistance division ratios inside the source driver, it is possible to obtain the advantage of highly accurate resistance division ratios as a feature obtained by IC formation. Supplying the voltages for all gray scale levels from an external circuit cannot be attained because a voltage accuracy of about 5 mV is required in the intermediate gray scale display area requiring the highest accuracy as described regarding the above-mentioned problem to be solved in the conventional drive method. The present embodiment has a voltage generation circuit capable of satisfying the characteristic obtained in consideration of the correction of the ΔV characteristic and also capable of generating gray scale voltages conforming to the y characteristic in an IC. Generally, the voltage division accuracy inside an IC can be set at an accuracy of about 1 mV or less, whereby it is possible to attain the accuracy required for the invention. The γ characteristic represents the relationship between a display signal input to a display device and a display characteristic, that is, the output of the display device. If the γ characteristic does not match the display signal and the display device, display images are saturated to the white or black side, causing viewers to feel uncomfortable. Since the γ characteristic differs depending on the display signal or the display device, it is necessary to determine gray scale voltages in consideration of the characteristic. However, generally, the value of the γ characteristic is nearly constant in the case of display signals such as a TV signal or VGA (Video Graphics Array) signal and in the case of display devices such as a CRT. Therefore, it is possible to determine gray scale voltages depending on the value. Furthermore, since limited kinds of liquid crystal materials are dominantly used for liquid crystal display devices, if the same liquid crystal material is used for display devices, the ΔV characteristic can be used commonly for such display devices having the drive circuit in accordance with the invention regardless of the screen size thereof.

(Embodiment 2)

Figure 7:
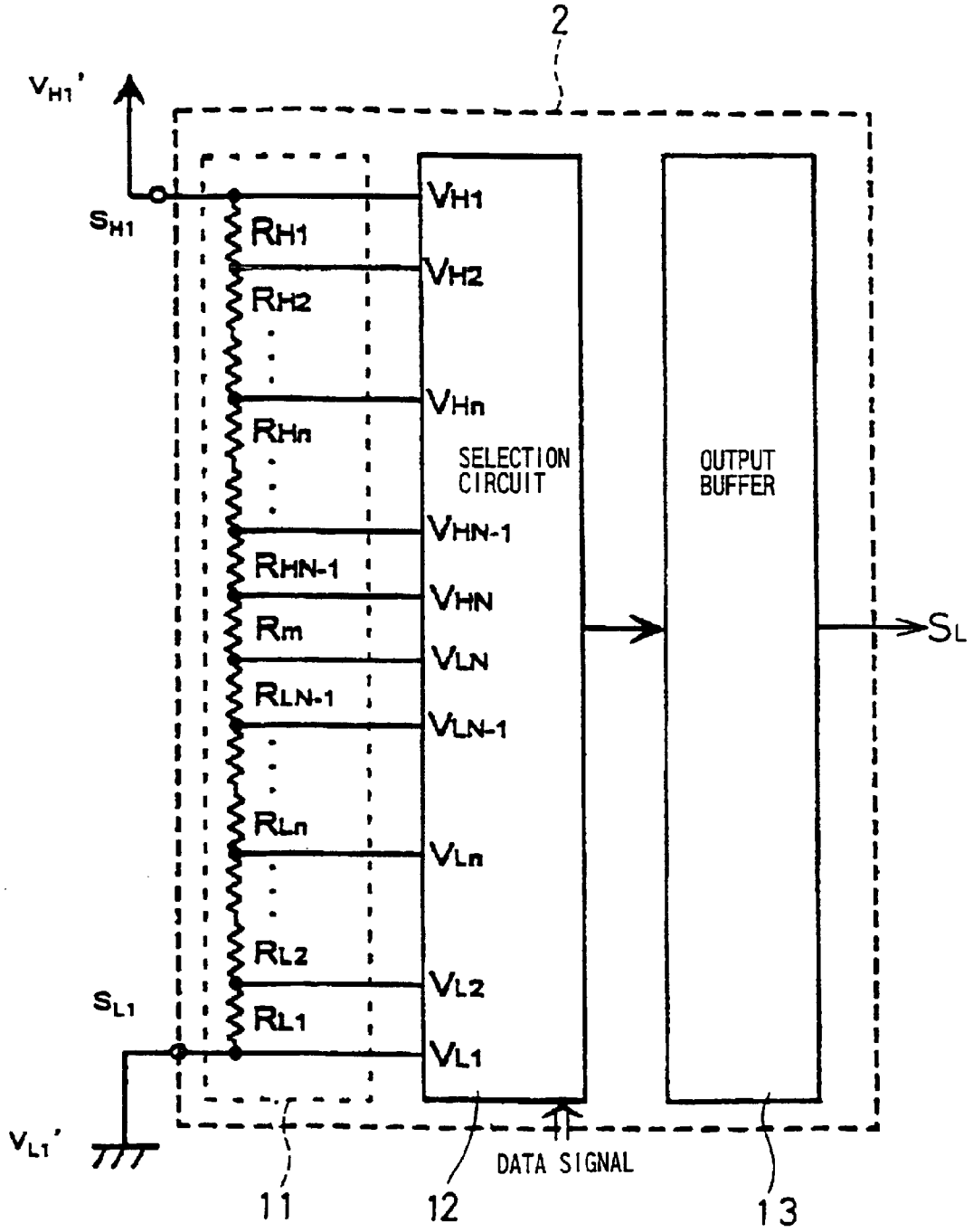
FIG. 7 is a block diagram showing the configuration of a source driver in accordance with embodiment 2 of the invention.

In embodiment 2, no gray scale reference voltage circuit is provided outside a source driver. As shown in FIG. 7, a source driver 2 comprises a gray scale voltage generation circuit 11, a selection circuit 12, an output buffer 13 and two input terminals $S_{H1}$ and $S_{L1}$ formed in an IC (integrated circuit). A positive-side highest-level gray scale reference voltage $V_{H1}'$ generated by an external power source is supplied to one of the input terminals, $S_{H1}$. A negative-side lowest-level gray scale reference voltage $V_{L1}'$ generated by the external power source is supplied to the other input terminal $S_{L1}$. The gray scale voltage generation circuit 11 of the source driver 2 generates a plurality of gray scale voltages based on the gray scale reference voltages $V_{H1}'$ and $V_{L1}'$ supplied externally. The selection circuit 12 selects one of the gray scale voltages depending on a data signal and outputs it to a source line 4 via the output buffer 13.

The gray scale voltage generation circuit 11 of the source driver 2 comprises a resistance-type voltage division circuit in which a plurality of resistors are connected in series just as in the case of the embodiment 1. In the case of N-level gray scale display for example, 2N−1 resistors are provided in series between the input terminals $S_{H1}$ and $S_{L1}$ in the order of $R_{H1}, R_{H2}, \ldots, R_{Hn}, \ldots, R_{HN-1}, R_m, R_{LN-1}, \ldots, R_{Ln}, \ldots$ and $R_{L1}$.

In the embodiment 2, the voltage between the positive-side highest-level gray scale reference voltage $V_{H1}'$ and the negative-side lowest-level gray scale reference voltage $V_{L1}'$ is divided by using the 2N−1 series resistors in the gray scale voltage generation circuit 11 to generate N positive-side gray scale voltages and N negative-side gray scale voltages, that is, 2N desired gray scale voltages in total. Just as in the case of the embodiment 1, all gray scale levels are set by the resistance-type voltage division circuit inside the source driver so that the gray scale display is made smooth and so that a desired γ characteristic is obtained. In addition, the positive-side voltage resistance division ratios and the negative-side voltage resistance division ratios are set so as to be asymmetrical with one another so that the correction of the level shift ΔV characteristic is performed completely.

Figure 8:
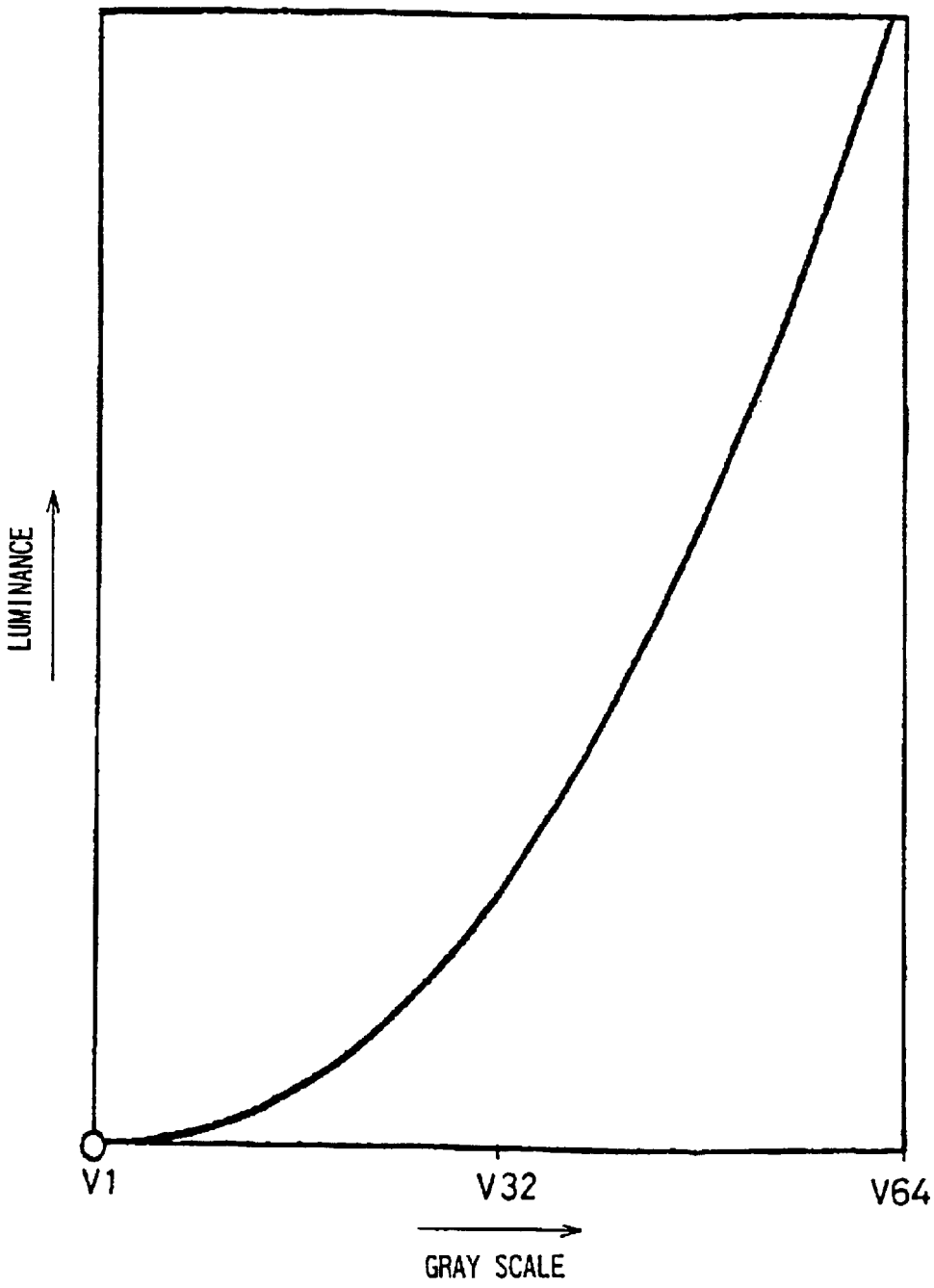
FIG. 8 is a graph showing luminance at all gray scale levels in accordance with the embodiment 2 of the invention.
Figure 9:
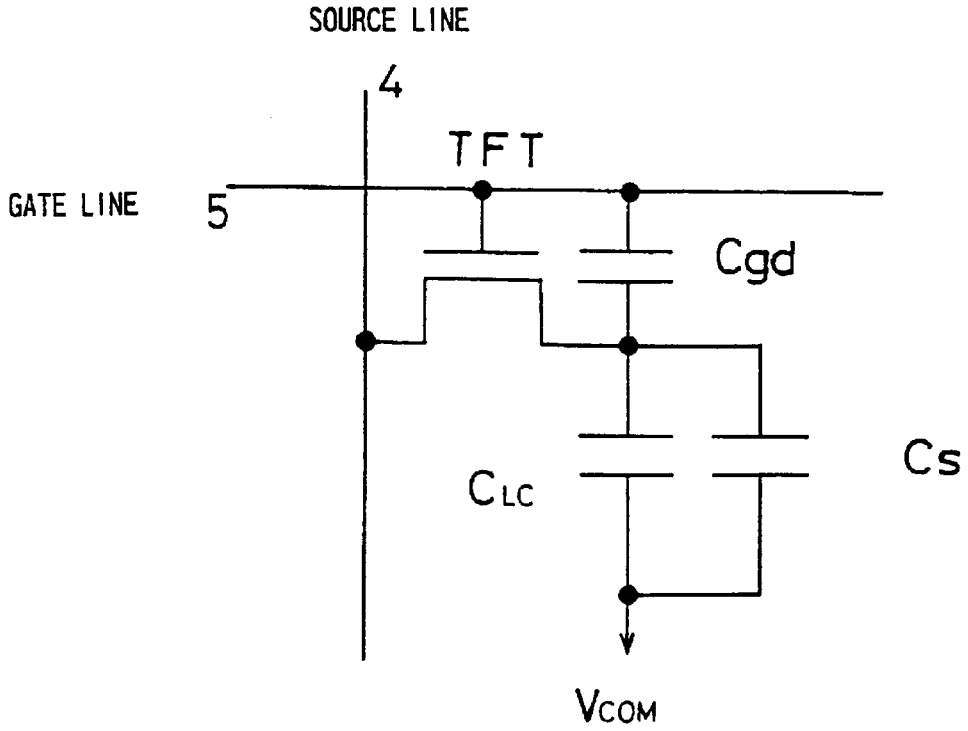
FIG. 9 Prior Art
FIG. 9 is an equivalent circuit diagram for a pixel in an active-matrix liquid crystal display device using TFTs as switching devices.
Figure 10:
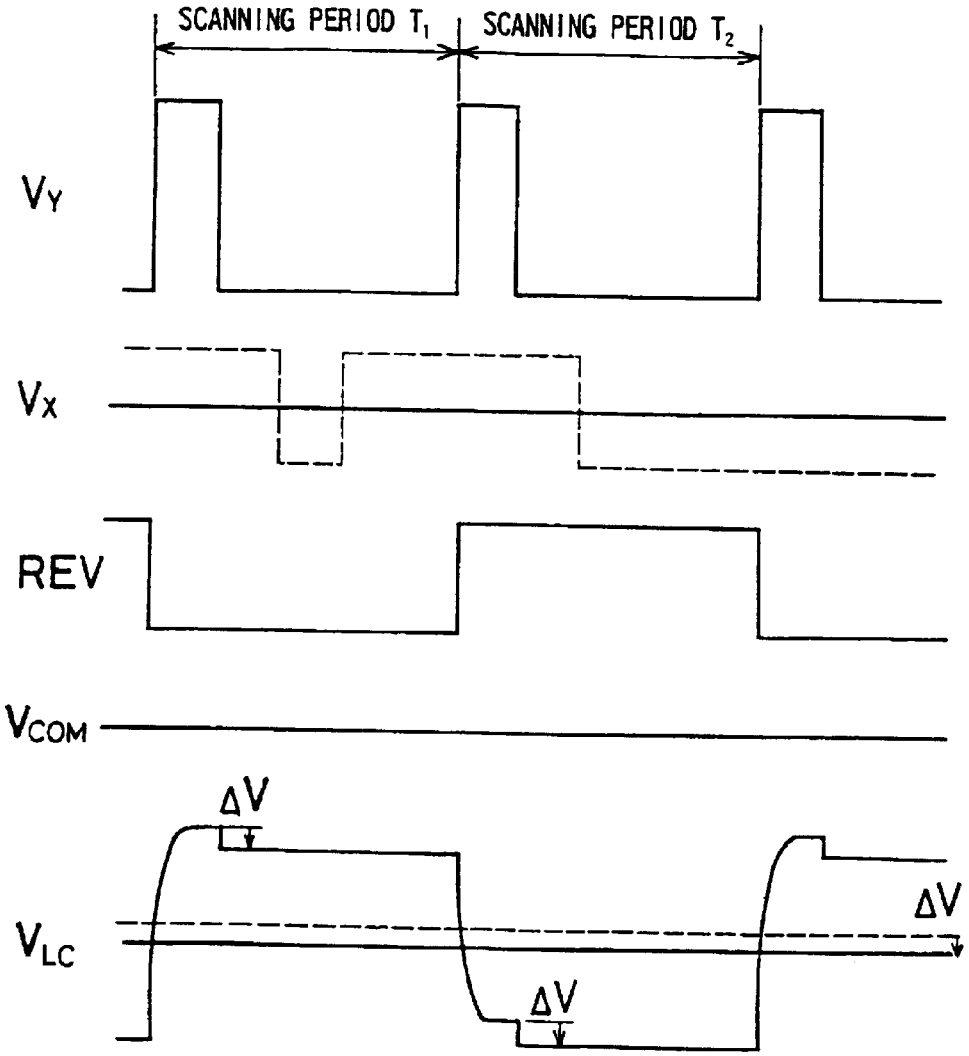
FIG. 10 Prior Art
FIG. 10 is a graph showing the waveform of a scanning voltage $V_Y$ supplied to a gate line 5, the waveform of a gray scale voltage $V_X$ supplied to a source line 4, the waveform of a polarity reversal signal REV, the waveform of a common electrode voltage $V_{COM}$ and the waveform of a liquid crystal cell voltage $V_{LC}$ generated by these voltages at a liquid crystal cell capacitance $C_{LC}$.
Figure 11:
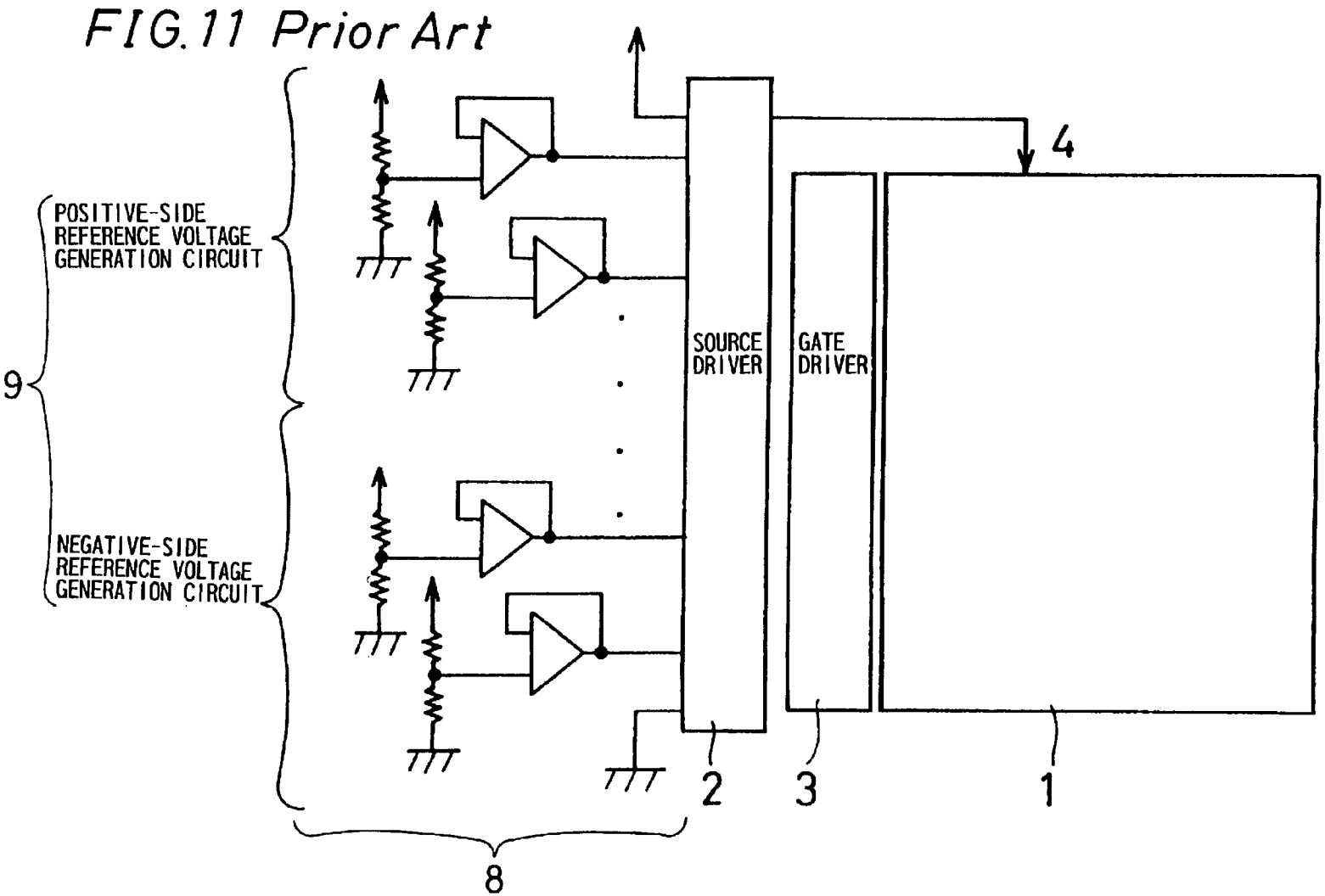
FIG. 11 Prior Art
FIG. 11 is a view showing a general configuration of a conventional active-matrix liquid crystal display device.
Figure 12:
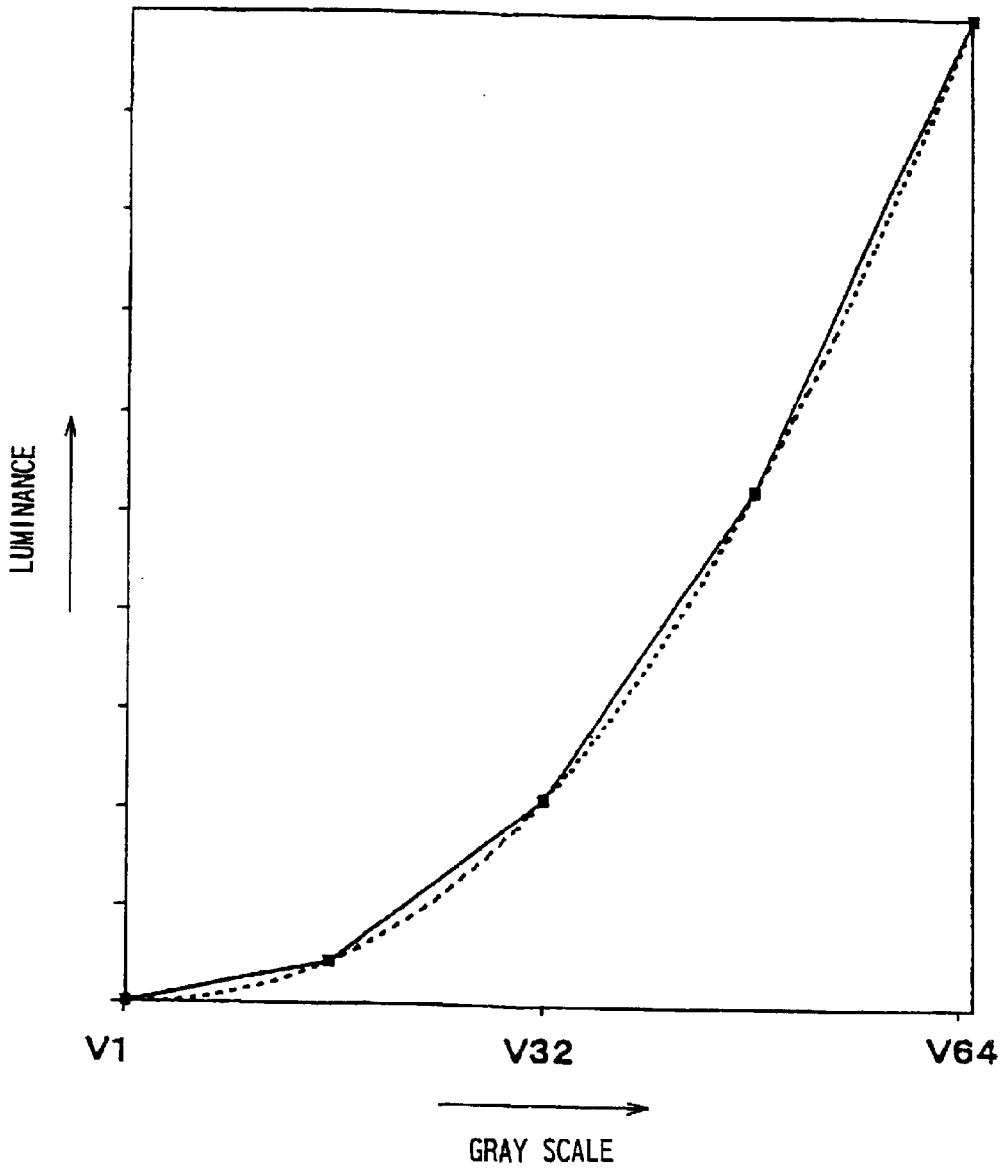
FIG. 12 Prior Art
FIG. 12 is a graph showing the characteristic with respect to gray scale and luminance in the case of five inputs.

FIG. 8 shows luminance at all gray scale levels in the case where the gray scale voltages generated by the resistance-type voltage division circuit of the source driver in accordance with the embodiment 2 are output to the source lines to drive the pixels of a liquid crystal panel. The abscissa of FIG. 8 represents gray scale, and the ordinate represents luminance in the case where the liquid crystal cell voltage $V_{LC}$ is applied to the liquid crystal layer of the liquid crystal panel at each gray scale level. The first-level gray scale voltage $V_1$ (indicated in black) is marked by o to indicate that a gray scale reference voltage is externally supplied as the first-level gray scale voltage $V_1$ from outside to the source driver in both cases of the positive-side and negative-side voltages. As shown in FIG. 8, by only inputting the positive-side highest-level gray scale reference voltage and the negative-side lowest-level gray scale reference voltage, it is possible to attain a liquid crystal display device capable of performing display in the range from the first-level gray scale voltage $V_1$ to the 64th-level gray scale voltage $V_{64}$ with the correction of the level shift ΔV characteristic and without unnatural change in luminance.

Furthermore, in an active-matrix liquid crystal display device provided with the source line drive circuit having the source driver of the embodiment 2, at the time of the adjustment of the common electrode voltage by using a flicker evaluation pattern, by only optimizing the common electrode voltage so that no flicker occurs at a certain gray scale pattern, it is possible to prevent flicker at all the other gray scale patterns. For this reason, the adjustment for optimizing the common electrode voltage can be carried out very easily in a short time.

As described above, in the embodiment 2, without providing a gray scale reference voltage generation circuit outside the source driver, by only supplying the positive-side highest-level gray scale reference voltage $V_{H1}'$ and the negative-side lowest-level gray scale reference voltage $V_{L1}'$ to the source driver, it is possible to output gray scale voltages, the center values of which have the characteristic indicated by the curve 32 of FIG. 13, since the resistance division ratios of the resistance-type voltage division circuit are set so that the correction of the level shift ΔV characteristic is carried out completely as described above. Therefore, it is possible to provide a liquid crystal display device having no deviation in the correction of the level shift ΔV characteristic and capable of completely solving the display problem of flicker and the like.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A source driver for supplying a plurality of gray scale voltages for driving each of a plurality of liquid crystal pixels required to be AC-driven, respectively, such that each said pixel displays a target gray scale level corresponding to a data signal supplied thereto, said source driver comprising:

a resistance-type voltage division circuit, which is an internal part of said source driver, for generating said plurality of gray scale voltages;

wherein (i) said resistance-type voltage division circuit includes a plurality of series connected resistors connected between at least one positive-side (high level) gray scale reference voltage and at least one negative-side (low level) gray scale reference voltage for generating gray scale voltages between each adjacent pair thereof, (ii) the resistors making up said series connected resistors located on said positive-side of said resistance-type voltage division circuit define positive-side (high level) resistance division ratios between them respectively, (iii) the resistors making up said series connected resistors located on said negative-side of said resistance-type voltage division circuit define negative-side (low level) resistance division ratios between them respectively, and (iv) said positive-side (high level) resistance division ratios and said negative-side (low level) resistance division ratios of the resistance-type voltage division circuit are set so as to be asymmetrical with one another depending on level shift characteristics respectively associated with each said target gray scale level generated between each adjacent pair of said series connected resistors.

2. The source driver of claim 1, further comprising:

two input terminals, to one of said input terminals being supplied a positive-side highest-level reference voltage and to the other of said input terminals being provided a negative-side lowest-level reference voltage, and positive-side and negative-side gray scale voltages are generated based on said highest-level reference voltage and said lowest-level reference voltage.

3. A source driver for supplying a plurality of gray scale voltages for driving each of a plurality of liquid crystal pixels required to be AC-driven, respectively, such that each said pixel displays a target gray scale level depending on a data signal supplied thereto, said source driver comprising:

a resistance-type voltage division circuit, which is an internal part of said source driver and includes a plurality of series connected resistors connected to at least one positive-side (high level) gray scale reference voltage and to at least one negative-side (low level) gray scale reference voltage, for generating said plurality of gray scale voltages, one between each adjacent pair of said series connected resistors;

wherein resistance division ratios between the respective resistors making up the resistance-type voltage division circuit are set to conform to the target gray scale display characteristics associated with said target gray scale levels.

4. The source driver of claim 3, further comprising:

two input terminals, to one of said input terminals being supplied a positive-side highest-level reference voltage, and to the other of said input terminals being provided a negative-side lowest-level reference voltage, and positive-side and negative-side gray scale voltages are generated based on said highest-level reference voltage and said lowest-level reference voltage.

5. A source line drive circuit, comprising:

a gray scale reference voltage generation circuit, and a source driver for supplying a plurality of gray scale voltages for driving each of a plurality of liquid crystal pixels required to be AC-driven, respectively, such that each said pixel displays a target gray scale level corresponding to a data signal supplied thereto, said source driver comprising:

a resistance-type voltage division circuit, which is an internal part of said source driver, for generating said plurality of gray scale voltages, wherein (i) said resistance-type voltage division circuit includes a plurality of series connected resistors connected between at least one positive-side (high level) gray scale reference voltage and at least one negative-side (low level) gray scale reference voltage for generating gray scale voltages between each adjacent pair thereof, (ii) the resistors making up said series connected resistors located on said positive-side of said resistance-type voltage division circuit define positive-side (high level) resistance division ratios between them respectively, (iii) the resistors making up said series connected resistors located on said negative-side of said resistance-type voltage division circuit define negative-side (low level) resistance division ratios between them respectively, (iv) said positive-side (high level) resistance division ratios and negative-side flow level) resistance division ratios of the resistance-type voltage division circuit are set so as to be asymmetrical with one another depending on level shift characteristics respectively associated with each said target gray scale level, and (v) said source driver is provided with a plurality of input terminals, to said plurality of input terminals are supplied gray scale reference voltages each having a different voltage level, and positive-side and negative-side gray scale voltages are generated based on the plurality of gray scale reference voltages.

6. A source line drive circuit, comprising:

a gray scale reference generation circuit, and a source driver for supplying a plurality of gray scale voltages for driving each of a plurality of liquid crystal pixels required to be AC-driven, respectively, such that each said pixel displays a target gray scale level depending on a data signal supplied thereto, said source driver comprising:

a resistance-type voltage division circuit, which is an internal part of said source driver and includes a plurality of series connected resistors connected to at least one positive-side (high level) gray scale reference voltage and at least one negative-side (low level) gray scale reference voltage, for generating said plurality of gray scale voltages, one between each adjacent pair of resistors;

wherein resistance division ratios between the respective resistors making up the resistance-type voltage division circuit are set to conform to the target gray scale display characteristics associated with said target gray scale levels, and wherein the source driver is provided with a plurality of input terminals, to said plurality of input terminals are supplied gray scale reference voltages each having a different voltage level, and positive-side and negative-side gray scale voltages are generated based on the plurality of gray scale reference voltages.

7. An active-matrix liquid crystal display device comprising:

a plurality of pixels disposed in a matrix;

a plurality of data signal lines disposed corresponding to columns of the pixels;

a plurality of scanning signal lines disposed corresponding to rows of the pixels;

switching devices at the individual pixels; and a source line drive circuit for driving the data signal lines, comprising, a gray scale reference voltage generation circuit, and a source driver for supplying a plurality of gray scale voltages for driving each of a plurality of liquid crystal pixels required to be AC-driven, respectively, such that each said pixel displays a target gray scale level corresponding to a data signal supplied thereto, said source driver comprising:

a resistance-type voltage division circuit, which is an internal part of said source driver and includes a plurality of series connected resistors connected to at least one positive-side (high level) gray scale reference voltage and at least one negative-side (low level) gray scale reference voltage, for generating said plurality of gray scale voltages, one between each adjacent pair of resistors;

wherein positive-side (high level) resistance division ratios and negative-side (low level) division ratios between the respective resistors making up the resistance-type voltage division circuit are set so as to be asymmetrical with one another depending on level shift characteristics respectively associated with each said target gray scale level; and wherein the source driver is provided with a plurality of input terminals, to said plurality of input terminals are supplied gray scale reference voltages each having a different voltage level, and positive-side and negative-side gray scale voltages are generated based on the plurality of gray scale reference voltages.

8. An active-matrix liquid crystal display device comprising:

a plurality of pixels disposed in a matrix;

a plurality of data signal lines disposed corresponding to columns of the pixels;

a plurality of scanning signal lines disposed corresponding to rows of the pixels;

switching devices at the individual pixels; and a source line drive circuit for driving the data signal lines, comprising:

a gray scale reference generation circuit, and a source driver for supplying a plurality of gray scale voltages for driving each of a plurality of liquid crystal pixels required to be AC-driven, respectively, such that each said pixel displays a target gray scale level depending on a data signal supplied thereto, said source driver comprising:

a resistance-type voltage division circuit, which is an internal part of said source driver and includes a plurality of series connected resistors connected to at least one positive-side (high level) gray scale reference voltage and at least one negative-side (low level) gray scale reference voltage, for generating said plurality of gray scale voltages one between each adjacent pair of resistors;

wherein resistance division ratios between the respective resistors making up the resistance-type voltage division circuit are set to conform to the target gray scale display characteristics associated with said target gray scale levels; and wherein the source driver is provided with a plurality of input terminals, to said plurality of input terminals are supplied gray scale reference voltages each having a different voltage level, and positive-side and negative-side gray scale voltages are generated based on the plurality of gray scale reference voltages.

9. A source driver for supplying a plurality of gray scale voltages for driving each of a plurality of liquid crystal pixels required to be AC-driven, respectively, such that each said pixel displays a target gray scale level depending on a data signal supplied thereto, said source driver comprising:

a resistance-type voltage division circuit, which is an internal part of said source driver and includes a plurality of series connected resistors connected between at least one positive-side (high level) gray scale reference voltage and at least one negative-side (low level) gray scale reference voltage, for generating said plurality of gray scale voltages, one between each adjacent pair of said resistors;

wherein resistance division ratios between the respective resistors the resistance-type voltage division circuit are set to conform to the target level shift characteristics and $\gamma$ characteristics of said target gray scale levels.

10. The source driver of claim 9, further comprising:

two input terminals, to one of said input terminals being supplied a positive-side highest-level reference voltage and to the other of said input terminals being provided a negative-side lowest-level reference voltage, and positive-side and negative-side gray scale voltages are generated based on said highest-level reference voltage and said lowest-level reference voltage.

11. A source line drive circuit, comprising:

a gray scale reference generation circuit, and a source driver for supplying a plurality of gray scale voltages for driving each of a plurality of liquid crystal pixels required to be AC-driven, respectively, such that each said pixel displays a target gray scale level depending on a data signal supplied thereto, said source driver comprising:

a resistance-type voltage division circuit, which is an internal part of said source driver and includes a plurality of series connected resistors connected to at least one positive-side (high level) gray scale reference voltage and at least one negative-side (low level) gray scale reference voltage, for generating said plurality of gray scale voltages, one between each adjacent pair of resistors;

wherein resistance division ratios between the respective resistors making up the resistance-type voltage division circuit are set to conform to the target level shift characteristics and $\gamma$ characteristics of said target gray scale levels; and wherein the source driver is provided with a plurality of input terminals, to said plurality of input terminals are supplied gray scale reference voltages each having a different voltage level, and positive-side and negative-side gray scale voltages are generated based on the plurality of gray scale reference voltages.

* * * * *